United States Patent [19]

Stange

[11] Patent Number: 4,547,063

[45] Date of Patent: Oct. 15, 1985

[54] MOVING MAGNET CLEANER

[75] Inventor: Klaus K. Stange, Pittsford, N.Y.

[73] Assignee: Xerox Corporation, Stamford, Conn.

[21] Appl. No.: 516,628

[22] Filed: Jul. 25, 1983

[51] Int. Cl.[4] ..... G03G 15/08

[52] U.S. Cl. ..... 355/15; 355/3 DD; 355/14 D; 118/652; 430/125

[58] Field of Search ..... 355/15, 3 DD, 14 D; 430/125; 118/652

[56] References Cited

U.S. PATENT DOCUMENTS

| | | | |
|---|---|---|---|
| Re. 28,566 | 10/1975 | Yang | 355/15 |
| 3,510,903 | 5/1970 | Stoever et al. | 15/256.5 |
| 3,634,077 | 1/1972 | Sullivan | 96/1.4 |
| 3,656,948 | 4/1972 | Mammino | 355/15 X |
| 3,659,311 | 5/1972 | Waren | 15/256.5 |
| 3,807,853 | 4/1974 | Hudson | 355/15 |
| 4,110,034 | 8/1978 | Sazuki | 355/15 |
| 4,116,555 | 9/1978 | Young et al. | 355/15 |
| 4,185,910 | 1/1980 | Nomura et al. | 355/15 |
| 4,201,465 | 5/1980 | Oyama et al. | 355/15 |

*Primary Examiner*—A. C. Prescott

*Attorney, Agent, or Firm*—Ronald F. Chapuran

[57] ABSTRACT

A moving magnet cleaner for scraping excess toner off a photoreceptor surface. The moving magnet cleaner provides carrier bristles for brushing the photoreceptor surface. The sweeping of the moving magnet cleaner past the photoreceptor provides a self-leveling of the carrier bristles to the size of the distance between the cleaner roll and the photoreceptor surface. A toner roll rotates in proximity to the cleaner roll to transfer toner from the carrier particles to the toner roll and also provides self-leveling of the carrier bristles. The carrier for the magnet cleaner is continually replacedwith carrier from a sump and the moving magnet cleaner exhibits a large cleaning zone allowing for gentle removal of the toner from the photoreceptor.

7 Claims, 5 Drawing Figures

MOVING MAGNET CLEANER

This invention relates to electrostatic imaging systems and more particularly, to an improved apparatus for cleaning electrostatic recording surfaces.

The prior art is replete with imaging surface cleaning devices such as brushes, webs, rollers and blades. For example, U.S. Pat. No. 3,510,903 shows a brush cleaner and a biased pick-off roll for removing particles from the cleaner. U.S. Pat. No. 3,634,077 shows a blade cleaner and the use of a biased pick-off roll for collecting and transporting toner particles removed by the cleaner. In U.S. Pat. No. 3,807,853 there is shown a foam roll cleaner and the use of reduced pressure or vacuum for removing toner particles from the cleaner.

It is also known to use reverse toner development approaches to cleaning imaging surfaces such as the use of a magnetic brush cleaning device as shown in U.S. Pat. No. Re. 28,566. In particular, when magnetic developer particles are used, the cleaning of the particles from the imaging surface is enhanced by taking advantage of their magnetic properties. In U.S. Pat. No. 3,659,311, there is disclosed a device for scavenging magnetizable powder from a drum in a printing apparatus. The powder is attracted from the drum to the surface of a non-magnetic tube positioned parallel to the drum. A rotatable set of adjacent magnets is supported within the tube. The rotation of the magnets causes a divergent magnetic flux field to attract the magnetizable powder and convey the powder around the surface of the tube. The powder then falls into a collection trough. Advantages of a magnetic brush cleaning apparatus include high cleaning efficiency and no damage to the electrostatic surface since the brushing engagement is very light.

U.S. Pat. No. 4,185,910 shows a photoconductor cleaning device having a magnetic brush commonly used for development and cleaning. In particular, when cleaning is performed, a low bias voltage is applied to the magnetic brush to prevent toner from passing from the magnetic brush to the photoconductive member. U.S. Pat. No. 4,116,555 describes a magnetic brush cleaner to remove toner from a photoreceptor and an electrically biased reclaim roller used to remove toner particles from the magnetic brush and U.S. Pat. No. 4,201,465 also shows a magnetic brush in a developing unit for removing residual toner.

One problem, however, that often exists in using magnetic brush cleaning apparatus is that with prolonged use, toner particles accumulate in the magnetic brush. This causes fatigue of the carrier particles and a deterioration in the cleaning efficiency. It is often necessary therefore to frequently replace the carrier particles in the cleaning apparatus, causing inefficient use of the carrier particles and an excessive maintenance requirement. A partial solution, as shown in U.S. Pat. No. 4,110,034, is to provide that the lower portion of the cylinder rotated in close proximity to the electrostatic surface be immersed in ferromagnetic carrier particles in a carrier container. Due to the force of the magnets within the cylinder, carrier particles adhere to the periphery of the cylinder to form a magnetic brush engaging the electrostatic surface. The magnets are arranged with alternating poles so that the carrier particles are alternately attracted and repelled facilitating movement of the toner particles to the periphery of the cylinder. A carrier scraper blade removes the radially outward extending carrier particles from the cylinder and guides them into a carrier container. A toner scraper blade subsequently removes the toner particles and returns the same to a toner container for recycling.

There still remains the problems of providing a magnetic cleaner that is not only efficient and minimizes the need for frequent replacement of the carrier particles, but also a magnetic cleaner with minimal wear whose stiffness can be tailored to a specific need. It would be desirable, therefore, to provide a magnetic cleaner that provides increased carrier life by increasing the active volume of carrier particles and by reducing the peripheral velocity of the cleaning roll. It would also be desirable to be able to tailor the stiffness of the cleaning brush by selecting the motion of the magnetic brush relative to the photoreceptor, by shaving the carrier bristles before making contact with the photoreceptor, and by compressing the bristles to a desired height or stiffness by proper selection of the gap between toner and cleaning rolls.

Accordingly, it is an object of the present invention to provide an improved moving magnet cleaner, in particular to provide an enlarged transfer zone created by moving and self-leveling magnets. It is another object of the present invention to provide increased carrier life as well as variable cleaning brush stiffness. Another object of the present invention is to provide improved and gentle cleaning by an extended cleaning zone.

Further advantages of the present invention will become apparent as the following description proceeds, and the features characterizing the invention will be pointed out with particularity in the claims annexed to and forming a part of this specification.

Briefly, the present invention is a moving magnet cleaner for scraping excess toner off a photoreceptor surface. The moving magnet cleaner provides carrier bristles for brushing the photoreceptor surface. The sweeping of the moving magnet cleaner past the photoreceptor provides a self-leveling of the carrier bristles to the size of the distance between the cleaner roll and the photoreceptor surface. A toner roll rotates in proximity to the cleaner roll to transfer toner from the carrier particles to the toner roll and also provides self-leveling of the carrier bristles. The carrier for the magnet cleaner is continually replaced with carrier from a sump and the moving magnet cleaner exhibits a large cleaning zone allowing for gentle removal of the toner from the photoreceptor.

For a better understanding of the present invention, reference may be had to the accompanying drawings wherein the same reference numerals have been applied to like parts and wherein.

For a general understanding of the features of the present invention, reference is made to the drawings.

Figure 1:
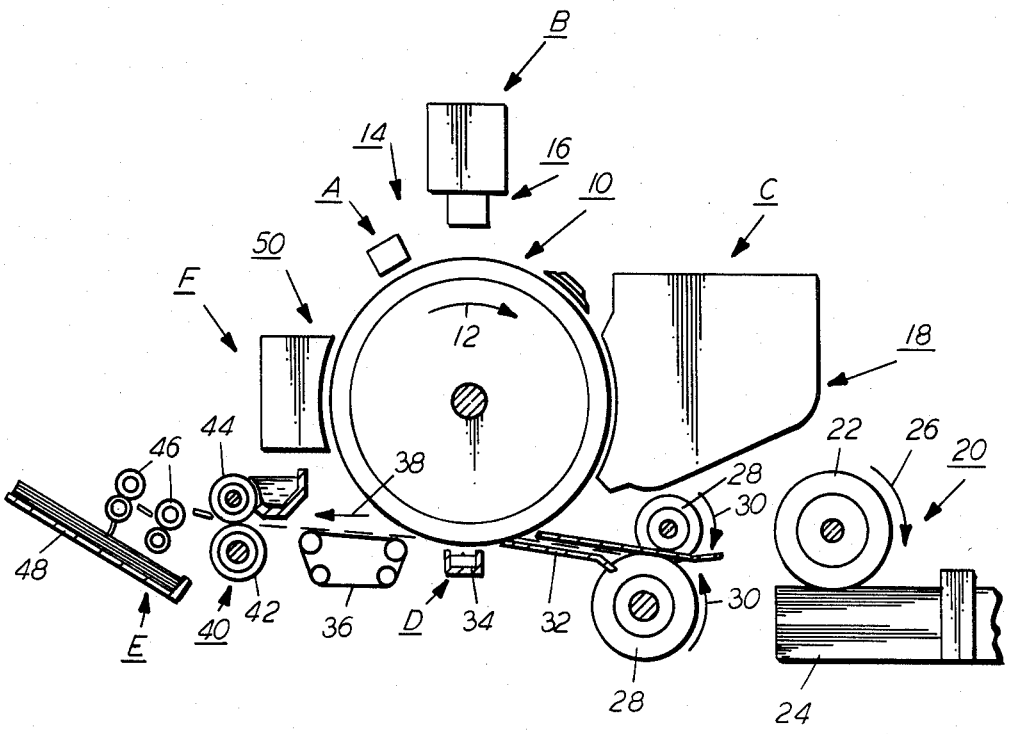
FIG. 1 is a schematic elevational view depicting an electrophotographic printing machine incorporating the elements of the present invention.

FIG. 1 schematically depicts the various components of an illustrative electrophotographic printing machine incorporating the magnetic cleaner of the present invention. It will become evident from the following discussion that the cleaning system described is equally well suited for use in a wide variety of electrostatographic printing machines and is not necessarily limited in its application to the particular embodiment shown.

As shown in FIG. 1, the electrophotographic printing machine employs a drum, indicated by the reference numeral 10. Preferably, drum 10 includes a conductive substrate, such as aluminum having a photoconductive material, e.g., a selenium alloy deposited thereon. Drum 10 rotates in the direction of arrow 12 to pass through various processing stations.

Initially, drum 10 moves a portion of the photoconductive surface through charging station A. At charging station A, a corona generating device, indicated by the reference numeral 14, charges the photoconductive surface of drum 10 to a relatively high, substantially uniform potential.

The charged portion of the photoconductive surface of drum 10 is then advanced through exposure station B. At exposure station B, an original document is positioned facedown upon a transparent platen. The exposure system, indicated by the reference numeral 16, includes a lamp which moves across the original document illuminating incremental portions of the document. The light rays reflected from the original document are transmitted through a moving lens system to form incremental light images. These light images are focused onto the charged portion of the photoconductive surface. In this manner, the charged photoconductive surface of drum 10 is discharged selectively by the light images of the original document. This records an electrostatic latent image on the photoconductive surface which corresponds to the informational areas contained within the original document.

Next, drum 10 advances the electrostatic latent image recorded on the photoconductive surface to development station C. At development station C, a magnetic brush development system, indicated by the reference numeral 18, transports a developer material into contact with the photoconductive surface of drum 10. The developer material, or a portion thereof, is attracted to the electrostatic latent image forming a toner powder image corresponding to the informational areas of the original document.

One skilled in the art will appreciate that either single component or two component developer material may be utilized. When two component materials are employed, the carrier granules are made preferably from a ferromagnetic material with the toner particles being made preferably from a thermoplastic material. The toner particles adhere triboelectrically to the carrier granules. During development, the toner particles are attracted to the electrostatic latent image so as to form a toner powder image on the or negatively with the potential applied to the photoconductive surface being of a polarity opposite thereto.

After the powder image is deposited on the photoconductive surface, drum 10 advances the powder image to transfer station D. At transfer station D, a sheet of support material is positioned in contact with the powder image formed on the photoconductive surface of drum 10. The sheet of support material is advanced to the transfer station by a sheet feeding apparatus, indicated by the reference numeral 20. Preferably, sheet feeding apparatus 20 includes a feed roll 22 contacting the uppermost sheet of the stack 24 of sheets of support material. Feed roll 22 rotates in the direction of arrow 26 so as to advance the uppermost sheet from stack 24. Registration rollers 28, rotating in the direction of arrows 30, align and forward the advancing sheet of support material into chute 32. Chute 32 directs the advancing sheet of support material into contact with the photoconductive surface of drum 10 in a timed sequence. This insures that the powder image contacts the advancing sheet of support material at transfer station D.

Transfer station D includes a corona generating device 34, which applies a spray of ions to the backside of the sheet. This attracts the powder image from the photoconductive surface of drum 10 to the sheet. After transfer, the sheet continues to move with drum 10 and is separated therefrom by a detack corona generating device (not shown) which neutralizes the charge causing the sheet to adhere to the drum. Conveyor 36 advances the sheet, in the direction of arrow 38, from transfer station D to fusing station E.

Fusing station E, indicated by the reference numeral 40, includes a back-up roller 42 and a heated fuser roller 44. The sheet of support material with the powder image thereon, passes between back-up roller 42 and fuser roller 44. The powder image contacts fuser roller 44 and the heat and pressure applied thereto permanently affixes it to the sheet of support material. Although a heated pressure system has been described for permanently affixing the particles to a sheet of support material, a cold pressure system may be utilized in lieu thereof. The particular type of fusing system employed depends upon the type of particles being utilized in the development system. After fusing, forwarding rollers 46 advance the finished copy sheet to catch tray 48. Once the copy sheet is positioned in catch tray 48, it may be removed therefrom by the machine operator.

After the sheet of support material is separated from the photoconductive surface of drum 10, residual particles remain on the photoconductive surface. These residual particles are cleaned from drum 10 at cleaning station F. Preferably, cleaning station F includes a cleaning mechanism 50 which comprises a moving magnetic brush in contact with the photoconductive surface of drum 10. The particles are cleaned from the photoconductive surface by the movement of the brush in contact therewith. Subsequent to cleaning, a discharge lamp floods the photoconductive surface with light to dissipate any residual electrostatic charge remaining thereon prior to the charging thereof for the next successive imaging cycle.

Figure 2:
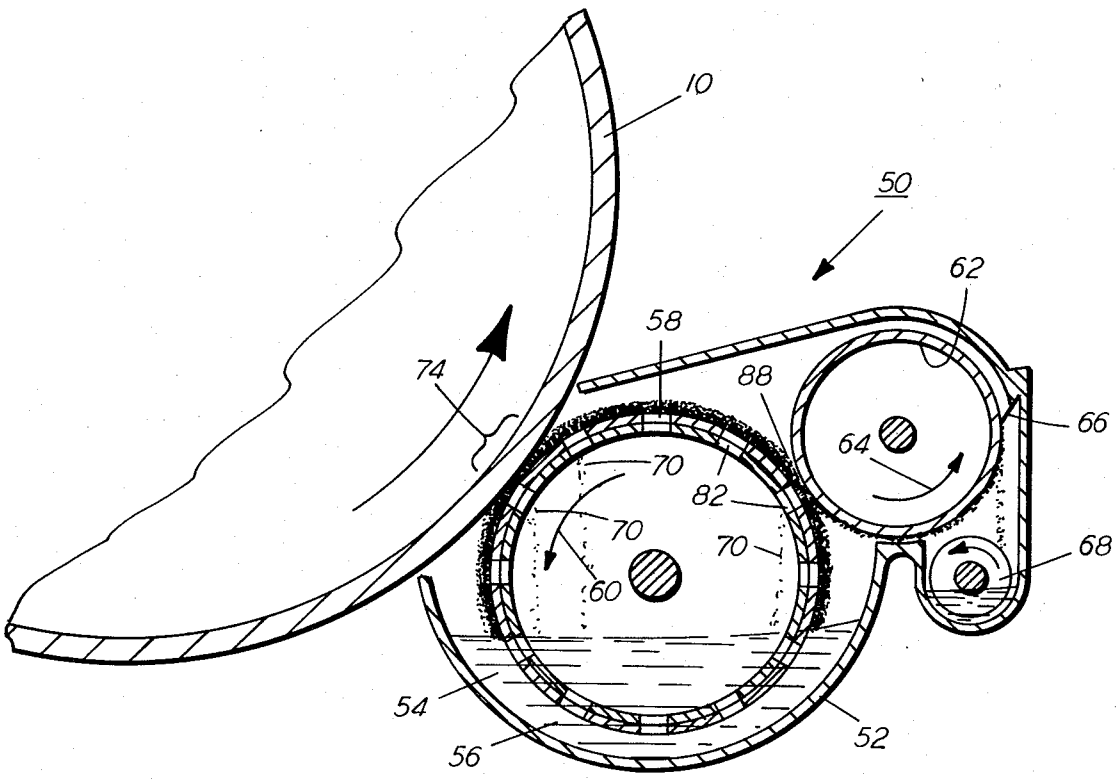
FIG. 2 is a schematic elevational view illustrating one embodiment of the magnetic cleaning system employed in the FIG. 1 printing machine.

In accordance with the present invention, FIG. 2 shows a moving magnetic cleaner in greater detail. Cleaner apparatus 50 includes a housing 52 defining a carrier sump 54 for storing a supply of carrier material 56 therein. Preferably, the cleaner apparatus is located below the photoreceptor surface of drum 10. The internal components of the apparatus are generally supported and aligned by molded plastic end plates. A magnetic cleaner roll, indicated by the reference numeral 58, is mounted rotatably within housing 52. As cleaning roller 58 rotates in the direction of arrow 60, it transports carrier material 56 into contact with the photoreceptor surface of drum 10. It should be noted, however, that the cleaning roll may operate in a direction with or against the photoreceptor motion.

The cleaner roll 58 rotates through the carrier material 56 in the bottom of the housing 52 and collects carrier beads forming a plurality of brushes or bristles on magnetic strips. The carrier material on the cleaning roll 58 is continuously replaced with carrier from the carrier sump 54, thus increasing the life of the carrier. The brushes or bristles are carried to the photoreceptor surface where they attract or scavenge toner particles adhering to the photoreceptor surface. By using appropriate bias on the cleaner roll 58 as well as correct photoreceptor to roll spacing, toner is mechanically and electrostatically removed from the photoreceptor surface.

Before the bristles or brushes reach the photoreceptor surface, however, any spurious toner particles adhering to the bristles are scavenged by the toner roll 62. In particular, the toner roll 62 rotates in a counterclockwise direction, as shown by arrow 64, and is electrically biased to attract any toner particles adhering to the bristles. The toner particles scavenged from the bristles by the toner roll 62 are stripped from the toner roll by a spring or metering blade 66 and dumped into a toner transport auger 68. Preferably, the toner roll 62 is a smooth, thin walled stainless steel roll. It may operate in a direction with or against the cleaner roll 58. By using a proper DC bias on the toner roll, toner is transferred from the carrier particles to the toner roll 62.

Figure 3:
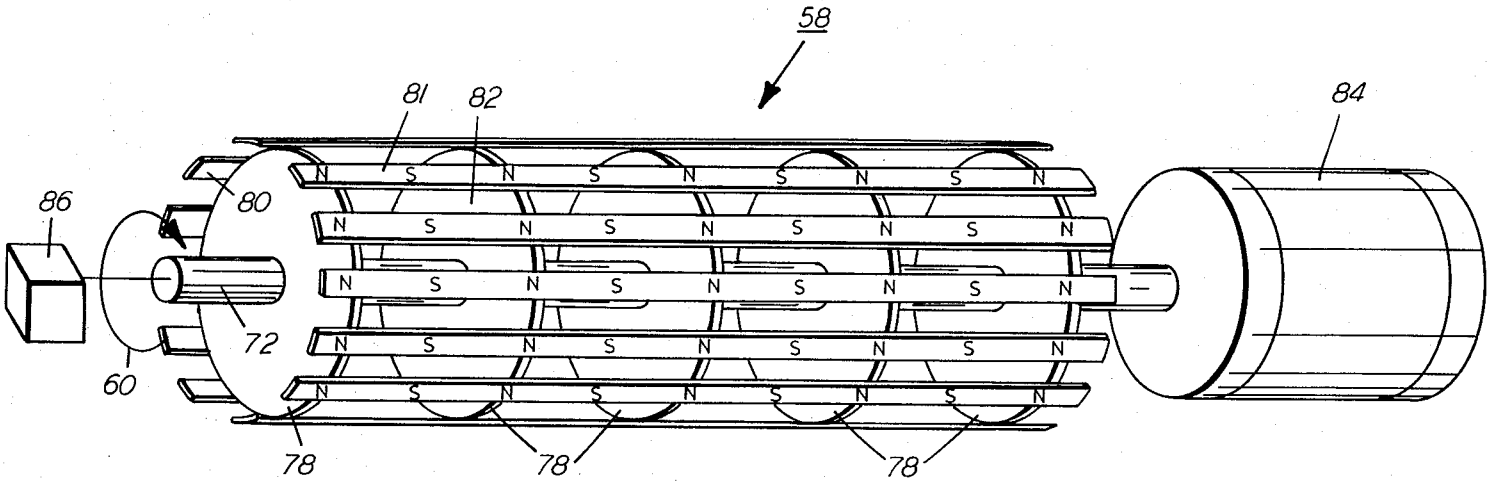
FIG. 3 is a schematic perspective view depicting the cleaner roll utilized in FIG. 2.

With reference to FIG. 3, there is shown the detailed structure of cleaner roll 58. A plurality of discs 78 or spoked plates are fastened to a common shaft 72. Bars 80 are supported by discs 78. Permanent magnetic strips 81 are adhesively secured to bars 80. Bars 80 are preferably substantially equally spaced from one another defining spaces 82 therebetween. In addition, bars 80 extend in a direction substantially parallel to the longitudinal axis of shaft 72. Preferably, bars 80 are made from a soft magnetic iron which provides sufficient stiffness and support to hold the permanent magnetic strips 81 secured thereto.

Spaces 82 permit the carrier material 56 to pass into the interior of cleaner roll 58. This allows the extraneous carrier material to escape from the nip between surface of drum 10 and cleaner roll 58, i.e. in cleaning zone 74 illustrated in FIG. 2. It also allows the carrier material to escape from the nip between the cleaner roll 58 and the toner roll 62, i.e. the transfer zone 88, also illustrated in FIG. 2. This is highly significant in that it provides for a gentle cleaning action which significantly improves the life of the photoreceptor surface. The self-leveling of the carrier bristles of the cleaner roll 58 is provided both at the cleaning zone 74 and at the toner transfer zone 88.

That is, at the toner transfer zone 88, between the cleaning roll 58 and the toner roll 62, the cleaning roll bristles of stacked carrier extend to a length greater than the distance between the cleaning roll 58 and the toner roll 62. The bristles, therefore, are leveled off and the portion of the bristle that is leveled off is free to escape through the elongated spaces 82. In a similar manner, at cleaning zone 74 between the photoreceptor surface and the cleaning roll 58, there is contact between the bristles of the cleaning roll 58 and the photoreceptor surface. The bristles are leveled off to the distance between the cleaning roll 58 and the photoreceptor surface, and the portion of the bristles leveled off are free to escape through spaces 82.

The cleaning action is provided by the magnetic attraction of the excess toner on the photoreceptor surface to the carrier bristles. Due to the self-leveling structure of the cleaning roll, the cleaning zone 74 can be relatively large with toner transfer spread over a larger area during a longer period of time. Also, the relatively large cleaning zone 74 is possible because the moving and self-leveling magnets on cleaning roll 58 permit the reduced velocity of the cleaning roll 58, allowing the gentle removal of toner from the photoreceptor surface. Also, there is the continuous supply of carrier available increasing the time period before replenishment of carrier is needed.

Motor 84 is coupled to shaft 72 to rotate cleaner roll 58 in the direction of arrow 60. Preferably, motor 84 maintains cleaner roll 58 rotating at a substantially constant angular velocity. Preferably, each magnetic strip 81 has a series of magnetic poles of alternating polarity impressed along the longitudinal axis thereof. Adjacent magnetic strips have magnetic poles of the same polarity opposed from one another.

In operation, as each magnetic strip 81 moves out of the carrier material disposed in the carrier sump 54, the outer surface will be covered with a fairly uniform layer of carrier material 56 providing bristles or brushes. As the magnetic strip moves into cleaning zone 74, the carrier material will be pulled through the zone. Carrier material which has difficulty in passing through the cleaning zone 74, is merely pushed into spaces 82 between adjacent magnetic strips 81. This self-leveling feature also permits large amounts of carrier material to be transported into the cleaning zone 74 without creating unmanageable build-ups.

Figure 4:
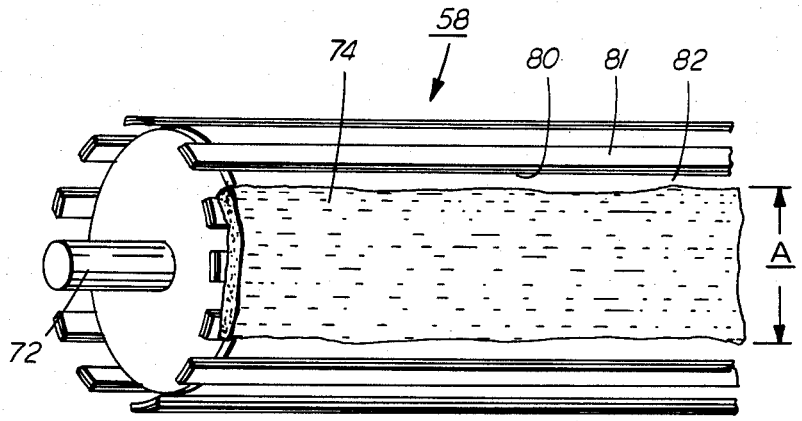
FIG. 4 is a fragmentary, schematic plan view illustrating the cleaning zone of the FIG. 3 cleaner roll.

It has been found that in operation the size of cleaning zone 74 is dependent upon the distance between magnetic strips 81 and the photoreceptor surface as well as the speed of movement of cleaning roll 58. As shown in FIG. 4, as the speed of cleaning roll 58 increases, the width A of the cleaning zone 74 decreases. Similarly, as the gap or distance between the photoreceptor surface and magnetic strips 81 decreases, the width A of cleaning zone 74 also increases. Thus, it is clear that the size of the cleaning zone may be suitably adjusted by regulating the speed or angular velocity of cleaning roll 58 relative to the photoreceptor surface and/or the gap between the magnetic strips and the surface. It is thus clear that the cleaning zone may be maintained reasonably wide so as to provide a considerable duration of time for the carrier bristles to brush the excess toner from the surface of drum 10.

Figure 5:
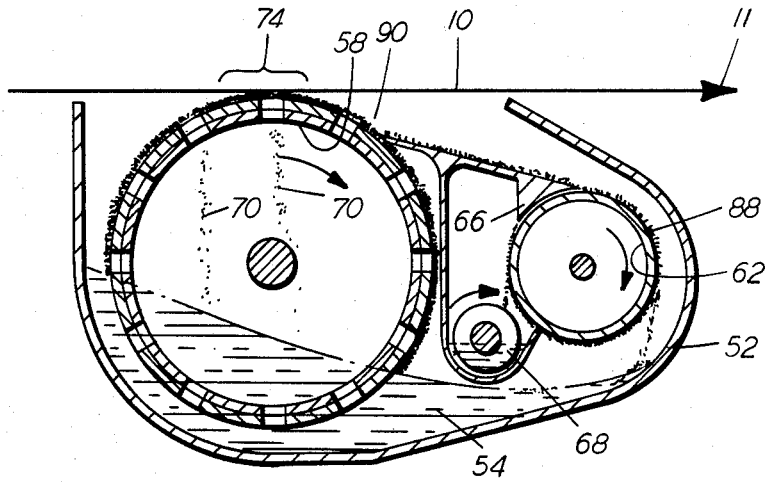
FIG. 5 is a schematic elevational view showing another embodiment of the magnetic cleaning system used in the FIG. 1 printing machine.

FIG. 5 is another embodiment of the moving magnet cleaner. There is shown a clockwise rotating cleaning roll 58 moving in relation to a photoreceptor surface or belt 10, moving in the direction of the arrow 11. Again, there is a cleaner housing 52 with a carrier sump portion 54 containing carrier particles. The cleaning zone is shown at 74 providing the self-leveling of the carrier bristles and the scavaging of toner from surface 10. In this embodiment, the toner roll 62 is shown rotating in a clockwise direction. In operation, the cleaning roll 58 rotates through the carrier sump to pick up carrier particles on the magnetic strips.

The cleaning roll 58 continues its clockwise direction rotation, and the cleaning roll bristles come into contact with the photoreceptor surface 10 at the cleaning zone 74. The bristles attract toner from the photoreceptor surface 10 and the elongated gaps in the cleaning roll 58 provide escape for the particles as the bristles are leveled in the cleaning zone. As the cleaning roll rotation continues, carrier particles are scavenged from the cleaning roll 58 by a carrier flow splitting edge illustrated at 90.

In particular, the toner transfer zone 88 is enlarged by separating the bristles from the cleaning roll 58 with the splitting edge 90 and then cascading the carrier material over the toner roll 62. The toner roll 62 continues in a clockwise direction, and the force of gravity causes the carrier particles to drop to the bottom of housing 52. Since the toner roll 62 is electrically biased, however, the toner particles remain attracted to the toner roll 62. The toner particles continue rotating with the toner roll until engaging the scraping blade 66, causing excess toner to be scraped from the toner roll into the toner transport auger 68.

The metering blade 66, secured to housing 52, has one edge thereof positioned closely adjacent to toner roll 62 defining a space through which the toner material passes. Metering blade 66 scrapes the toner material from toner roll 62. The extraneous toner material that is separated from toner roll 62 returns to the toner transport auger 58. Cleaning roll 58 continues rotation in the clockwise direction as shown to again pick up carrier bristles and bring them into contact with the photoreceptor surface.

As in FIG. 2, the carrier bristles contact the photoreceptor surface and extraneous carrier material 56 passes through spaces in the cleaning roll 58 to return to the carrier sump 54. The extraneous carrier material 56 is illustrated by the downward vertical arrows 70 extending from spaces 82 in the cleaner roll 58.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a reproduction machine having a photoreceptor, means for developing a latent electrostatic image on the photoreceptor to produce a developed image, means for transferring the developed image from the photoreceptor to a transfer member, and a cleaning apparatus for removing residual toner from the photoreceptor, the cleaning apparatus disposed adjacent the photoreceptor and comprising:

a magnetic cleaner roll disposed adjacent to the photoreceptor and having a plurality of carrier bristles, a carrier housing including a carrier sump provided with a supply of carrier material, the magnetic cleaner roll positioned for rotation within a portion of the carrier sump, a toner roll disposed near the magnetic cleaner roll for scavenging toner from the carrier bristles, the magnetic cleaner roll being disposed intermediate the photoreceptor and the toner roll, and self-leveling means comprising a pre-determined distance between the surfaces of the toner roll and the cleaner roll, portions of the carrier bristles in excess of the distance between the surfaces of the toner and cleaner rolls being scraped from said bristles, said self-leveling means leveling the carrier bristles to said pre-determined size.

2. The cleaner of claim 1 wherein the self-leveling means is provided by the engagement of the magnetic cleaner roll with the photoreceptor surface, portions of the carrier bristles in excess of the distance between the photoreceptor surface and the magnetic cleaner roll being scraped from the bristles.

3. The cleaner of claim 2 including means to convey the scraped portions of the carrier bristles at the self-leveling means back to the carrier sump.

4. The cleaning apparatus of claim 1 including a splitting edge extending between the cleaner roll and the toner roll, said splitting edge stripping the top portions of the carrier bristles from the cleaning roll and conveying the top portions to the toner roll.

5. The method of claim 1 including the step of stripping the toner from the toner roll into a toner depository.

6. A method of cleaning toner from the surface of a photosensitive member in an electrophotographic machine in which a magnetic toner is used as a developer, the machine including a rotatable cylindrical magnetic cleaner roll having a plurality of carrier bristles, a rotating toner roll charged to attract toner, said toner roll disposed adjacent the cleaner roll, and a sump storing a quantity of carrier material for continually replenishing the carrier bristles on the cleaner roll, the cleaner roll rotating within the sump, the surfaces of the cleaner roll and the toner roll being separated a pre-determined distance, said distance providing a leveling of the carrier bristles, comprising the steps of moving said bristles in engagement with the photosensitive member to remove magnetic toner attached thereto, transferring the magnetic toner attached to the bristles of the cylindrical brush onto the rotating toner roll charged to attract the toner, replenishing the carrier bristles on the cleaner roll by rotating the cleaner roll through the sump, and leveling the carrier bristles to a given size by moving the bristles between the toner and cleaner rolls having said pre-determined distance.

7. The method of claim 6 including the step of rotating the bristles between the space between the cleaner roll and the photoreceptor surface to level the bristles to another given size.

* * * * *